US005371325A

United States Patent [19]

Kalola et al.

[11] Patent Number: 5,371,325

[45] Date of Patent: Dec. 6, 1994

[54] INSULATION SYSTEM FOR MAGNETIC DEVICES

[75] Inventors: Purushottam C. Kalola, Garland; Mathew Joseph, Mesquite, both of Tex.

[73] Assignee: AT&T Corp., Murray Hill, N.J.

[21] Appl. No.: 968,692

[22] Filed: Oct. 30, 1992

[51] Int. Cl.[5] ..... H01B 7/00

[52] U.S. Cl. ..... 174/117 F; 174/110 FC; 174/117 R; 174/120 SR

[58] Field of Search ..... 174/117 F, 117 R, 110 FC, 174/120 R, 120 SR

[56] References Cited

U.S. PATENT DOCUMENTS

| | | | |
|---|---|---|---|
| 3,488,537 | 1/1970 | Beddows | 174/110 FC |
| 3,684,755 | 8/1972 | Gumerman | 174/110 FC X |
| 4,628,003 | 12/1986 | Katz | 174/110 FC |
| 4,801,501 | 1/1989 | Harlow | 174/120 SR X |
| 4,900,879 | 2/1990 | Buck et al. | 174/120 |
| 5,025,115 | 6/1991 | Sayegh et al. | 174/117 F |

FOREIGN PATENT DOCUMENTS

| | | | |
|---|---|---|---|
| 3405302 | 9/1985 | Germany | 174/117 F |
| 105406 | 4/1989 | Japan | 174/117 F |
| 26009 | 1/1992 | Japan | 174/117 F |

OTHER PUBLICATIONS

"Teflon FEP", by Du Pont, *Du Pont Materials for Wire and Cable,* Sep. 1990.

"Teflon 4100", by Du Pont, *Du Pont Materials for Wire and Cable,* Sep. 1990.

"Litz Wire", by *New England Electric Wire Corporation,* pp. 14–15.

*Primary Examiner*—Morris H. Nimmo

*Attorney, Agent, or Firm*—Alfred G. Steinmetz

[57] ABSTRACT

A new insulation system comprising film coated, copper magnet wires covered under NEMA Standards No. MW1000, insulated with single or multiple layer(s) of extruded TEFLON® (any color) fluorocarbon resin insulation to meet the government or safety agency promulgated performance and construction requirements.

6 Claims, 2 Drawing Sheets

INSULATION SYSTEM FOR MAGNETIC DEVICES

FIELD OF THE INVENTION

This invention relates to wire or conductor insulation systems and, in particular, to a system and method of insulating the conductors of a winding for use on a magnetic device.

BACKGROUND OF THE INVENTION

Proper insulation is one of the fundamental design considerations in any electrical or electronic component or device. In a multiwinding magnetic component such as transformers, inductors, and electric motors, proper insulation must be provided between the various windings and between the windings and the magnetic core. Further consideration must be given to providing proper insulation protection to certain critical winding locations such as winding terminations. Not only is such insulation essential to insure proper functioning of the component and any associated circuitry and to provide personal safety, but in most applications of use the component must meet specific government or safety agency promulgated performance and construction requirements.

The insulation system of a transformer for office machinery typically achieves these requirements by using insulated windings combined with a multiple turn insulating tape wrapping positioned between different windings to achieve several layers of insulation and by using multiple wire sleevings at the terminal ends of the windings. This particular construction insures that multiple layers of insulation, as may be required by government or safety agency requirements, will always appear between the primary and secondary windings. Since coating, spraying, potting and painting of insulation on the wire does not normally meet such agency promulgated safety requirements, the insulation must always comprise a layered film of insulation with the required number of layers between windings being specified, numbers of layers between windings being specified differently in different jurisdictions but most often being normally three layers.

These required margin tapes, tape wrapping, and sleeving operations constitute a substantial portion of the overall cost of the transformer. Furthermore, the complexity of the insulation construction results in a reduction of production yields of acceptable transformers thereby further increasing their cost.

SUMMARY OF THE INVENTION

A new insulation system comprising triple insulated film coated magnet wires using extruded TEFLON (tm) insulation eliminates the need for special insulation enhancement at the terminal ends of the windings. This significantly reduces the labor involved in the production of magnetic components.

In one particular illustrative embodiment of the invention single, or double or triple extruded TEFLON (tin) is used over multiple stranded film coated magnet wire.

The insulation system may comprise one or more layer(s) of 0.0005" or thicker TEFLON® fluorocarbon resins, or MYLAR® KEPTON or polyester, or any combination of above composition used over (extruded or coated or wrapped) the MW-28-C, MW-2-C, MW-15-C, MW-75-C, MW-5-C, MW-30-C, MW-24-C, MW-76-C, MW-26-C, MW-78-C, MW-35-C, MW-36-C, MW-16-C, and all other wires covered under NEMA Standard Publication No. MW-1000, single or heavier built enamel film coated copper wires sizing 1 AWG and above to meet government or safety agency promulgated performance and construction requirements. The copper magnet wire(s) may be arranged in many configurations.

DETAILED DESCRIPTION

Figure 1:
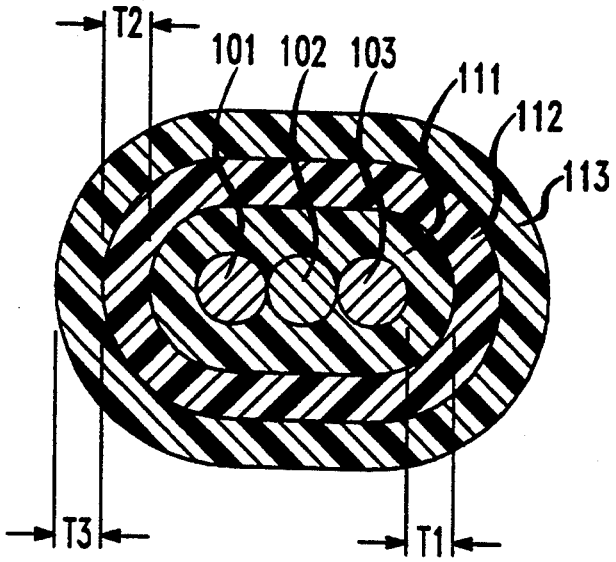
FIG. 1 is a cross-sectional view of a triple strand MW-28 copper magnet wire for application to a magnetic component insulated with three layers of extruded TEFLON® FEP (fluorocarbon resin).

A triple insulated multistrand wire for a magnetic component is disclosed in a cross-sectional view in the FIG. 1. Three copper magnet wires (MW-28-CS) 101, 102 and 103 are arranged in a parallel ribbon configuration all positioned in a common plane. The parallel ribbon arrangement is particularly suitable in applications requiring a low profile component. In the illustrative embodiment, the wire sized may range from 1 AWG and larger.

The three magnet wire strands 101, 102 and 103 are surrounded in common by three layers of extruded Fluorinated Ethylene Propylene (4100 TEFLON®) insulation 111, 112 and 113, each having a thickness T1, T2 and T3, respectively. The thickness of each layer, in the illustrative embodiment, is a guaranteed 0.4 mm dimension, and the overall three layer total insulation wall thickness is a 9 mil dimension. The three layers of extrusion may be performed in one operation.

This scheme of insulation has been found to satisfy the insulation requirements for Class A, Class B and Higher Temperature Classes to meet IEC380, IEC950, IEC750, UL1950, CSA950, CSA234, EN60950, all NORDIC, DENTORI, and government safety agency requirements.

Figure 2:
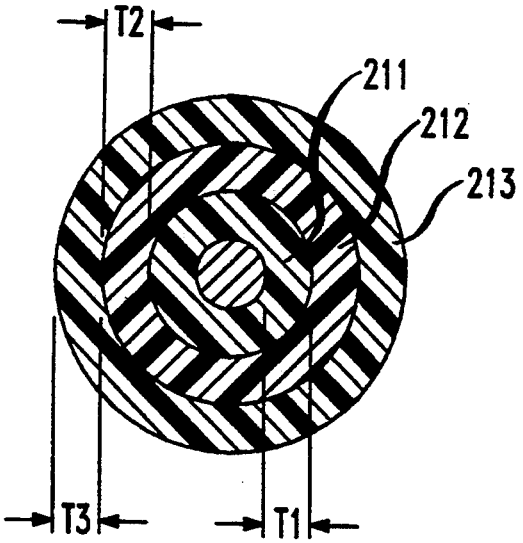
FIG. 2 is a cross-sectional view of a single strand MW-28 copper magnet wire for application to a magnetic component insulated with three layers of extruded TEFLON® FEP (fluorocarbon resin).

A triple insulated single strand wire for a magnetic component is disclosed in a cross-sectional view in the FIG. 2. A single copper magnet wire (MW-28-CS) 201, whose wire size may range from 1 AWG and larger, is surrounded in common by three layers of extruded Fluorinated Ethylene Propylene (4100 TEFLON®) insulation 211,212 and 213, each having a thickness T1, T2 and T3, respectively. The thickness of each layer, in the illustrative embodiment, is a guaranteed 3 mils dimension, and the overall three layer total insulation wall thickness is a 9 mil dimension. The three layers of extrusion may be performed in one operation.

This scheme of insulation also satisfies the insulation requirements for Class A, Class B and Higher Temperature Classes to meet IEC380, IEC950, IEC750, UL1950, CSA950, CSA234, EN60950, all NORDIC, DENTORI, and government safety agency requirements.

Figure 3:
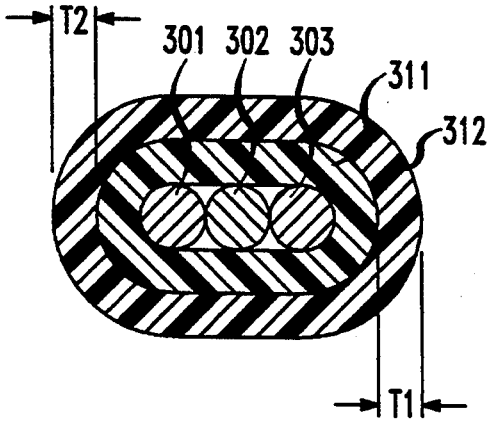
FIG. 3 is a cross-sectional view of three strands MW-28 copper magnet wire for application to a magnetic component insulated with two layers of extruded TEFLON® Flip (fluorocarbon resin).

A double insulated multistrand wire for a magnetic component is disclosed in a cross-sectional view in the FIG. 3. Three copper magnet wires (MW-28-CS) 301, 302 and 303 are arranged in a parallel ribbon configuration and all are positioned in a common plane. The parallel ribbon arrangement, as described above, is particularly suitable in applications requiting a low profile component. In the illustrative embodiment, the wire sized may range from 1 AWG and above.

The three magnet wire strands 301,302 and 303 are surrounded in common by two layers of extruded Fluorinated Ethylene Propylene (4100 TEFLON®) insulation 311 and 312, each having a thickness T1 and T2, respectively. The thickness of each layer, in the illustrative embodiment, is a guaranteed 3 mils dimension, and the overall two layer total insulation wall thickness is a 6 mil dimension. The two layers of extrusion may be performed in one operation.

This scheme of insulation has been found to satisfy the insulation requirements for Class A, Class B and Higher Temperature Classes to meet IEC380, IEC950, IEC750, UL1950, CSA950, CSA234, EN60950, all NORDIC, DENTORI, and government safety agency requirements.

Figure 4:
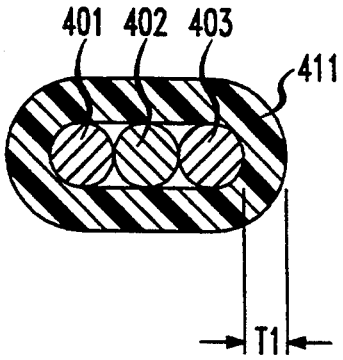
FIG. 4 is a cross-sectional view of a three strand MW-28 copper magnet wire for application to a magnetic component insulated with one layer of coated TEFLON® FEP (fluorocarbon resin).

A single insulated multistrand wire for a magnetic component is disclosed in a cross-sectional view in the FIG. 4. Three copper magnet wires (MW-28-CS) 401,402 and 403 are arranged in a parallel ribbon configuration all positioned in a common plane. The parallel ribbon arrangement is particularly suitable in applications requiring a low profile component. In the illustrative embodiment, the wire size may range from 1 AWG and above.

The three magnet wire strands 401,402 and 403 are surrounded in common by a single layer of extruded Fluorinated Ethylene Propylene (4100 TEFLON®) insulation 411 which has having a thickness T1. The thickness of this layer, in the illustrative embodiment, is a guaranteed 3 mils dimension which is also the overall insulation wall thickness. The single layers of extrusion is performed in one operation.

This scheme of insulation has been found to satisfy the insulation requirements for Class A, Class B and Higher Temperature Classes to meet IEC380, IEC950, IEC750, UL1950, CSA950, CSA234, EN60950, all NORDIC, DENTORI, and government safety agency requirements.

Figure 5:
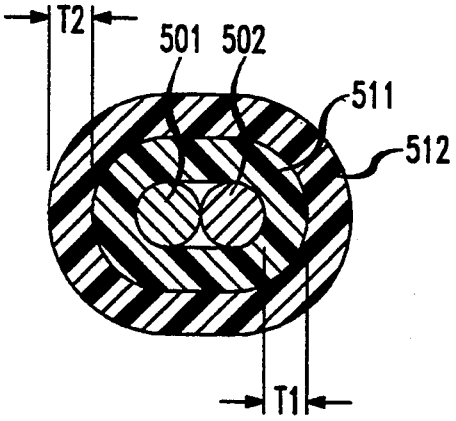
FIG. 5 is a cross sectional view of a two strand MW-28 copper magnet wire for application to a magnetic component insulated with two layers of coated TEFLON® FEP (fluorocarbon resin).

A double insulated multistrand wire for a magnetic component is disclosed in a cross-sectional view in the FIG. 5. Two copper magnet wires (MW-28-CS) 501 and 503 are arranged in a parallel ribbon configuration all positioned in a common plane. The parallel ribbon arrangement is particularly suitable in applications requiring a low profile component. In the illustrative embodiment, the wire size may range from 1 AWG and above.

The two magnet wire strands 501 and 502 are surrounded in common by two layers of extruded Fluorinated Ethylene Propylene (4100 TEFLON®) insulation 511 and 512, each having a thickness T1 and T2, respectively. The thickness of each layer, in the illustrative embodiment, is a guaranteed 3 mils dimension, and the overall two layer total insulation wall thickness is a 6 mil dimension. The two layers of extrusion may be performed in one operation.

This scheme of insulation has been found to satisfy the insulation requirements for Class A, Class B and Higher Temperature Classes to meet IEC380, IEC950, IEC750, UL1950, CSA950, CSA234, EN60950, all NORDIC, DENTORI, and government safety agency requirements.

Figure 6:
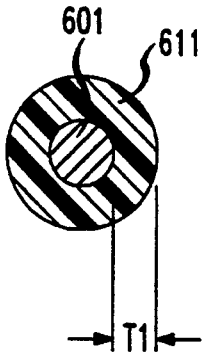
FIG. 6 is a cross sectional view of a single strand MW-28 copper magnet wire for application to a magnetic component insulated with one layer of coated TEFLON® FEP (fluorocarbon resin).

A single insulated single strand wire for a magnetic component is disclosed in a cross-sectional view in the FIG. 6. A single copper magnet wire (MW-28-CS) 601, whose size may range range from 1 AWG and above, is surrounded by a single layers of extruded Fluorinated Ethylene Propylene (4100 TEFLON®) insulation 611 having a thickness T1. The thickness of this layer, in the illustrative embodiment, is a guaranteed 3 mils dimension, which is also the overall total insulation wall thickness. The single layer of extrusion is performed in one operation.

This scheme of insulation has been found to satisfy the insulation requirements for Class A, Class B and Higher Temperature Classes to meet IEC380, IEC950, IEC750, UL1950, CSA950, CSA234, EN60950, all NORDIC, DENTORI, and government safety agency requirements.

We claim:

1. A winding for a magnetic component, comprising:

a first, second and third conductor of magnet wire composition arranged in a planar ribbon configuration in electrical contact with each other;

a single layer of extruded Fluorinated Ethylene Propylene insulation surrounding the planar ribbon formed by the first, second and third conductor to form a single conducting wire.

2. A winding for a magnetic component, comprising:

a first and second conductor of magnet wire composition arranged in a planar ribbon configuration in electrical contact with each other;

a first and second layer of extruded Fluorinated Ethylene Propylene insulation surrounding the planar ribbon formed by the first and second conductor to form a single conducting wire.

3. A winding for a magnetic component, comprising:

a first, second and third conductor of magnet wire composition arranged in a planar ribbon configuration in electrical contact with each other;

a first and second layer of extruded Fluorinated Ethylene Propylene insulation surrounding the planar ribbon formed by the first second and third conductor to form a single conducting wire.

4. A winding for a magnetic component, comprising:

a conductor of magnet wire composition, a first and second layer of extruded Fluorinated Ethylene Propylene insulation surrounding the conductor to form a conducting wire.

5. A magnetic winding comprising, three magnet wires arranged in a parallel ribbon configuration all positioned in a common plane in electrical contact with each other and the three magnet wires surrounded in common by three successive layers of adjacent or extruded Fluorinated Ethylene Propylene insulation to form a single conducting wore.

6. A magnetic winding as claimed in claim 5, wherein the layers of extruded Fluorinated Ethylene Propylene insulation each have a thickness of at least 3 mils.

* * * * *